US010844739B2

(12) United States Patent
Aggarwala et al.

(10) Patent No.: US 10,844,739 B2
(45) Date of Patent: Nov. 24, 2020

(54) PLATFORMS WITH LEADING EDGE FEATURES

(71) Applicant: United Technologies Corporation, Farmington, CT (US)

(72) Inventors: Andrew S. Aggarwala, Vernon, CT (US); Russell J. Bergman, Windsor, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/195,316

(22) Filed: Nov. 19, 2018

(65) Prior Publication Data

US 2019/0153885 A1 May 23, 2019

Related U.S. Application Data

(63) Continuation of application No. 14/937,360, filed on Nov. 10, 2015, now Pat. No. 10,132,182.
(Continued)

(51) Int. Cl.
*F01D 9/02* (2006.01)
*F01D 11/04* (2006.01)
*F01D 11/00* (2006.01)

(52) U.S. Cl.
CPC ..... *F01D 11/04* (2013.01); *F01D 9/02* (2013.01); *F01D 11/001* (2013.01);
(Continued)

(58) Field of Classification Search
CPC ..... F01D 11/04; F01D 9/02; F01D 11/001; F01D 11/005; F05D 2240/127; F05D 2240/57; F05D 2240/80
See application file for complete search history.

(56) References Cited

U.S. PATENT DOCUMENTS 5,429,478 A * 7/1995 Krizan ..... F01D 11/001 415/115
6,152,690 A 11/2000 Tomita et al.
(Continued)

FOREIGN PATENT DOCUMENTS

| | | |
|---|---|---|
| EP | 2687682 A2 | 1/2014 |
| GB | 780382 A | 7/1957 |
| WO | 2013130181 A2 | 9/2013 |

OTHER PUBLICATIONS

European Search Report from the European Patent Office for EP Application No. 15194388.3 dated Apr. 12, 2016; 10 pages.

*Primary Examiner* — David E Sosnowski
*Assistant Examiner* — Theodore C Ribadeneyra
(74) *Attorney, Agent, or Firm* — Cantor Colburn LLP

(57) ABSTRACT

A platform includes a platform body. The platform body has an airfoil support surface, an axially extending base surface opposite the airfoil support surface, and a leading edge. The leading edge includes an upstream extending flange with a raised portion and a trough portion downstream of and radially inward from the raised portion. The raised portion and the trough portion are for holding a vortex of fluid flow. The upstream extending flange includes a converging surface connecting the upstream extending flange to the base surface. The converging surface converges in a direction toward the axially extending base surface and is at an angle relative to the base surface.

18 Claims, 5 Drawing Sheets

Related U.S. Application Data

(60) Provisional application No. 62/078,609, filed on Nov. 12, 2014.

(52) U.S. Cl.
CPC ..... *F01D 11/005* (2013.01); *F05D 2240/127* (2013.01); *F05D 2240/57* (2013.01); *F05D 2240/80* (2013.01)

(56) References Cited

U.S. PATENT DOCUMENTS 7,249,928 B2 * 7/2007 Klasing ..... F01D 11/001 415/115
7,465,152 B2 12/2008 Nigmatulin
8,419,356 B2 * 4/2013 Little ..... F01D 11/001 415/173.1
2006/0269400 A1 * 11/2006 Girgis ..... F01D 5/081 415/115
2008/0145208 A1 * 6/2008 Klasing ..... F01D 5/082 415/173.7
2008/0145216 A1 * 6/2008 Klasing ..... F01D 5/143 415/208.2
2010/0008760 A1 * 1/2010 Morris ..... F01D 11/001 415/115
2010/0040479 A1 * 2/2010 Spangler ..... F01D 11/006 416/97 R
2012/0051900 A1 * 3/2012 Clements ..... F01D 5/143 415/208.2
2012/0051930 A1 * 3/2012 Pandey ..... F01D 5/143 416/223 A
2013/0028735 A1 * 1/2013 Burt ..... F01D 5/187 416/1
2013/0108430 A1 * 5/2013 Zimmermann ..... F01D 11/005 415/208.1
2013/0108450 A1 * 5/2013 Ingram ..... F01D 5/143 416/223 A
2013/0108451 A1 * 5/2013 Ingram ..... F01D 5/145 416/223 A
2013/0115096 A1 5/2013 Itzel et al.
2013/0170983 A1 * 7/2013 Babu ..... F01D 11/04 416/1
2013/0224014 A1 8/2013 Aggarwala et al.
2013/0224026 A1 8/2013 Piersall et al.
2013/0224027 A1 * 8/2013 Barr ..... F01D 5/143 416/193 A
2014/0020392 A1 1/2014 Hase et al.
2014/0083113 A1 * 3/2014 Greene ..... F01D 11/001 60/805

* cited by examiner

PLATFORMS WITH LEADING EDGE FEATURES

CROSS REFERENCE TO RELATED APPLICATIONS

This application is a continuation of Non-provisional application Ser. No. 14/937,360, filed Nov. 10, 2015 which in turn claims the benefit of Provisional Patent Application 62/078,609, filed Nov. 12, 2014, each of which are incorporated herein by reference in their entirety.

BACKGROUND

1. Field

The present disclosure relates to airfoil platforms, such as rotor blade platforms and vane platforms.

2. Description of Related Art

Traditionally, turbomachines, as in gas turbine engines, include multiple stages of rotor blades and vanes to condition and guide fluid flow through the compressor and/or turbine sections. Stages in some engine sections can include alternating rotor blade stages and stator vane stages. Each respective stage includes at least one platform for mounting the rotors and stators. The platforms of a given stage are generally mounted circumferentially together using a feather seal. Feather seals between the platforms in a given stage can help to prevent ingestion of unwanted fluid flow at the axial interfaces between the platforms.

Ingestion of unwanted fluid flow can also occur at the circumferential interface between the platforms of two separate stages. At the circumferential interfaces, high pressure purge flow from the compressor can be used to reduce ingestion, but can potentially cause performance losses as a tradeoff.

Such conventional methods and systems have generally been considered satisfactory for their intended purpose. However, there is still a need in the art for improved airfoil platforms.

SUMMARY OF THE DISCLOSURE

A platform includes a platform body. The platform body has an airfoil support surface, an axially extending base surface opposite the airfoil support surface, and a leading edge. The leading edge includes an upstream extending flange with a raised portion and a trough portion downstream of and radially inward from the raised portion. The raised portion and the trough portion are for holding a vortex of fluid flow. The upstream extending flange includes a converging surface connecting the upstream extending flange to the base surface. The converging surface converges in a direction toward the axially extending base surface and is at an angle relative to the base surface.

The raised portion of the leading edge can be configured to be axially overlapped by a downstream extending flange of an upstream platform. The platform can include an axially extending feather seal opening defined between the airfoil support surface and the base surface. The axial position of the upstream edge of the feather seal opening can be substantially equal to the axial position of the intersection of the base surface and the converging surface, and/or the axial position of the upstream edge of the feather seal opening can be substantially equal to the axial position of the upstream edge of the base surface. The axial length of the raised portion can be substantially equal to the axial length of the opening of the trough portion. The airfoil support surface can be operatively connected to a stator vane.

A turbomachine includes a first platform including a downstream extending flange and a second platform downstream of the first platform. The second platform includes an airfoil support surface and an axially extending base surface opposite the airfoil support surface, and a leading edge. The leading edge is similar to the leading edge described above. The downstream extending flange of the first platform axially overlaps the raised portion of the leading edge of the second platform. When at equilibrium temperature, the axial position of the downstream edge of the downstream extending flange is substantially equal to the axial position of the intersection of the raised portion and the trough portion.

The second platform can include a feather seal opening, similar to the feather seal opening described above. The radial distance between a bottom of the trough portion and an outer surface of the downstream extending flange can be approximately two times the radius of curvature of the trough portion. The first platform can be a blade platform operatively connected to a rotor blade. The blade platform can be configured to move circumferentially with respect to the second platform while still maintaining an axial overlap between the downstream extending flange of the blade platform and the raised portion of the leading edge of the second platform. The second platform can be a vane platform operatively connected to a stator vane.

In one embodiment, a platform is provided. The platform having: a platform body having: an airfoil support surface; an axially extending base surface opposite the airfoil support surface; and a leading edge including an upstream extending flange with a raised portion and a trough portion downstream of and radially inward from the raised portion for holding a vortex of fluid flow, and wherein the upstream extending flange includes a converging surface connecting the upstream extending flange to the base surface, wherein the converging surface converges in a direction toward the axially extending base surface and is at an angle relative to the base surface.

In addition to one or more of the features described above, or as an alternative to any of the foregoing embodiments, the raised portion of the leading edge may be configured to be axially overlapped by a downstream extending flange of an upstream platform.

In addition to one or more of the features described above, or as an alternative to any of the foregoing embodiments, further embodiments may include an axially extending feather seal opening defined between the airfoil support surface and the base surface.

In addition to one or more of the features described above, or as an alternative to any of the foregoing embodiments, an axial position of an upstream edge of the feather seal opening may be substantially equal to an axial position of an intersection of the base surface and the converging surface.

In addition to one or more of the features described above, or as an alternative to any of the foregoing embodiments, an axial position of an upstream edge of the feather seal opening may be substantially equal to an axial position of the upstream edge of the base surface.

In addition to one or more of the features described above, or as an alternative to any of the foregoing embodiments, an axial length of the raised portion may be substantially equal to an axial length of an opening of the trough portion.

In addition to one or more of the features described above, or as an alternative to any of the foregoing embodiments, the airfoil support surface may be operatively connected to a stator vane.

In another embodiment, a platform is provided. The platform having: a platform body having: an airfoil support surface; an axially extending base surface opposite the airfoil support surface; an axially extending feather seal opening defined between the airfoil support surface and the base surface; and a leading edge including an upstream extending flange with a raised portion and a trough portion downstream of and radially inward from the raised portion for holding a vortex of fluid flow, wherein an axial position of an upstream edge of the feather seal opening is substantially equal to an axial position of the upstream edge of the base surface.

In addition to one or more of the features described above, or as an alternative to any of the foregoing embodiments, the upstream extending flange includes a converging surface connecting the upstream extending flange to the base surface, wherein the converging surface converges in a direction toward the axially extending base surface and is at an angle relative to the base surface.

In addition to one or more of the features described above, or as an alternative to any of the foregoing embodiments, the axial position of the upstream edge of the feather seal opening may be substantially equal to an axial position of an intersection of the base surface and the converging surface.

In yet another embodiment, a turbomachine is provided. The turbomachine having: a first platform including a downstream extending flange; and a second platform downstream of the first platform, wherein the second platform includes: an airfoil support surface; an axially extending base surface opposite the airfoil support surface; and a leading edge including an upstream extending flange with a raised portion and a trough portion downstream of and radially inward from the raised portion for holding a vortex of fluid flow, wherein the downstream extending flange of the first platform axially overlaps the raised portion of the leading edge of the second platform, and wherein, when at equilibrium temperature, an axial position of a downstream edge of the downstream extending flange is substantially equal to an axial position of an intersection of the raised portion and the trough portion.

In addition to one or more of the features described above, or as an alternative to any of the foregoing embodiments, the upstream extending flange includes a converging surface connecting the upstream extending flange to the base surface, wherein the converging surface converges in a direction toward the axially extending base surface and is at an angle relative to the base surface.

In addition to one or more of the features described above, or as an alternative to any of the foregoing embodiments, further embodiments may include an axially extending feather seal opening defined between the airfoil support surface and the base surface, wherein an upstream edge of the feather seal opening is defined at an axial position substantially equal to an axial position of an intersection of the base surface and the converging surface.

In addition to one or more of the features described above, or as an alternative to any of the foregoing embodiments, further embodiments may include an axially extending feather seal opening defined between the airfoil support surface and the base surface.

In addition to one or more of the features described above, or as an alternative to any of the foregoing embodiments, an axial position of an upstream edge of the feather seal opening may be substantially equal to an axial position of the upstream edge of the base surface.

In addition to one or more of the features described above, or as an alternative to any of the foregoing embodiments, an axial length of the raised portion may be substantially equal to an axial length of an opening of the trough portion.

In addition to one or more of the features described above, or as an alternative to any of the foregoing embodiments, a radial distance between a bottom of the trough portion and an outer surface of the downstream extending flange is approximately two times a radius of curvature of the trough portion.

In addition to one or more of the features described above, or as an alternative to any of the foregoing embodiments, the first platform is a blade platform operatively connected to a rotor blade, wherein the blade platform is configured to move circumferentially with respect to the second platform while still maintaining an axial overlap between the downstream extending flange of the blade platform and the raised portion of the leading edge of the second platform.

In addition to one or more of the features described above, or as an alternative to any of the foregoing embodiments, the second platform is a vane platform operatively connected to a stator vane.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE DISCLOSURE

Figure 1:
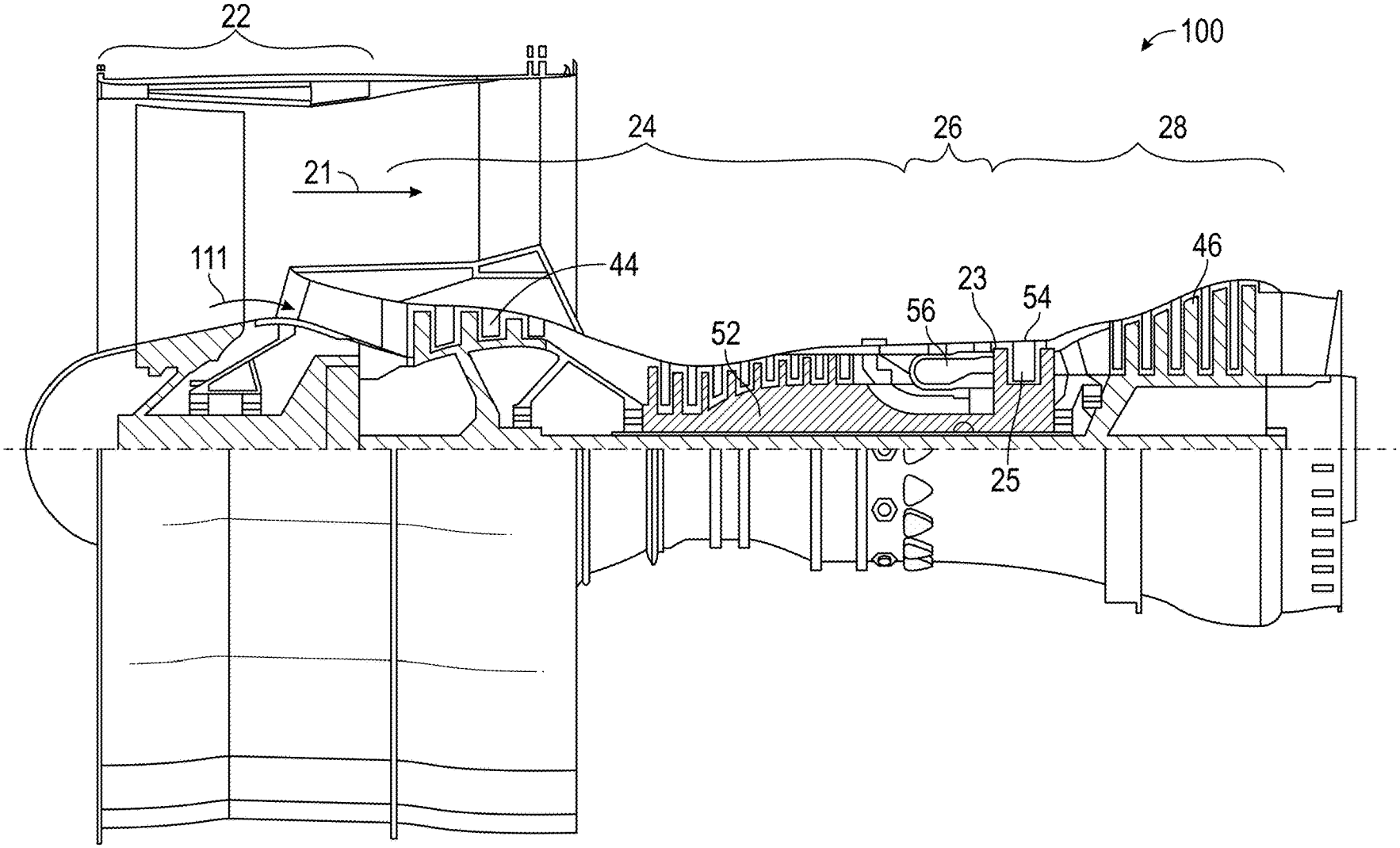
FIG. 1 is a schematic cross-sectional side elevation view of a portion of an exemplary embodiment of a gas turbine engine constructed in accordance with the present disclosure, showing the gas path and blades and vanes defined within the gas path.

Reference will now be made to the drawings wherein like reference numerals identify similar structural features or aspects of the subject disclosure. For purposes of explanation and illustration, and not limitation, a schematic side elevation view of an exemplary embodiment of a turbomachine constructed in accordance with the disclosure is shown in FIG. 1 and is designated generally by reference character 100. Other embodiments of turbomachines constructed in accordance with the disclosure, or aspects thereof, are provided in FIG. 2, as will be described.

As shown in FIG. 1, a turbomachine 100, for example, a gas turbine engine, includes a fan section 22, a compressor section 24, a combustor section 26 and a turbine section 28. The fan section 22 drives air along a bypass flow path 21, while the compressor section 24 drives air along a core flow path, e.g. main gas path 111, for compression and communication into the combustor section 26 then expansion through the turbine section 28. The core airflow is compressed by a low pressure compressor 44 then a high pressure compressor 52, mixed and burned with fuel in a combustor 56, then expanded over a high pressure turbine 54 and a low pressure turbine 46. Gas turbine engine 100 includes a plurality of airfoil stages, for example blade stages 23 and vane stages 25, which are in main gas path 111.

Figure 2:
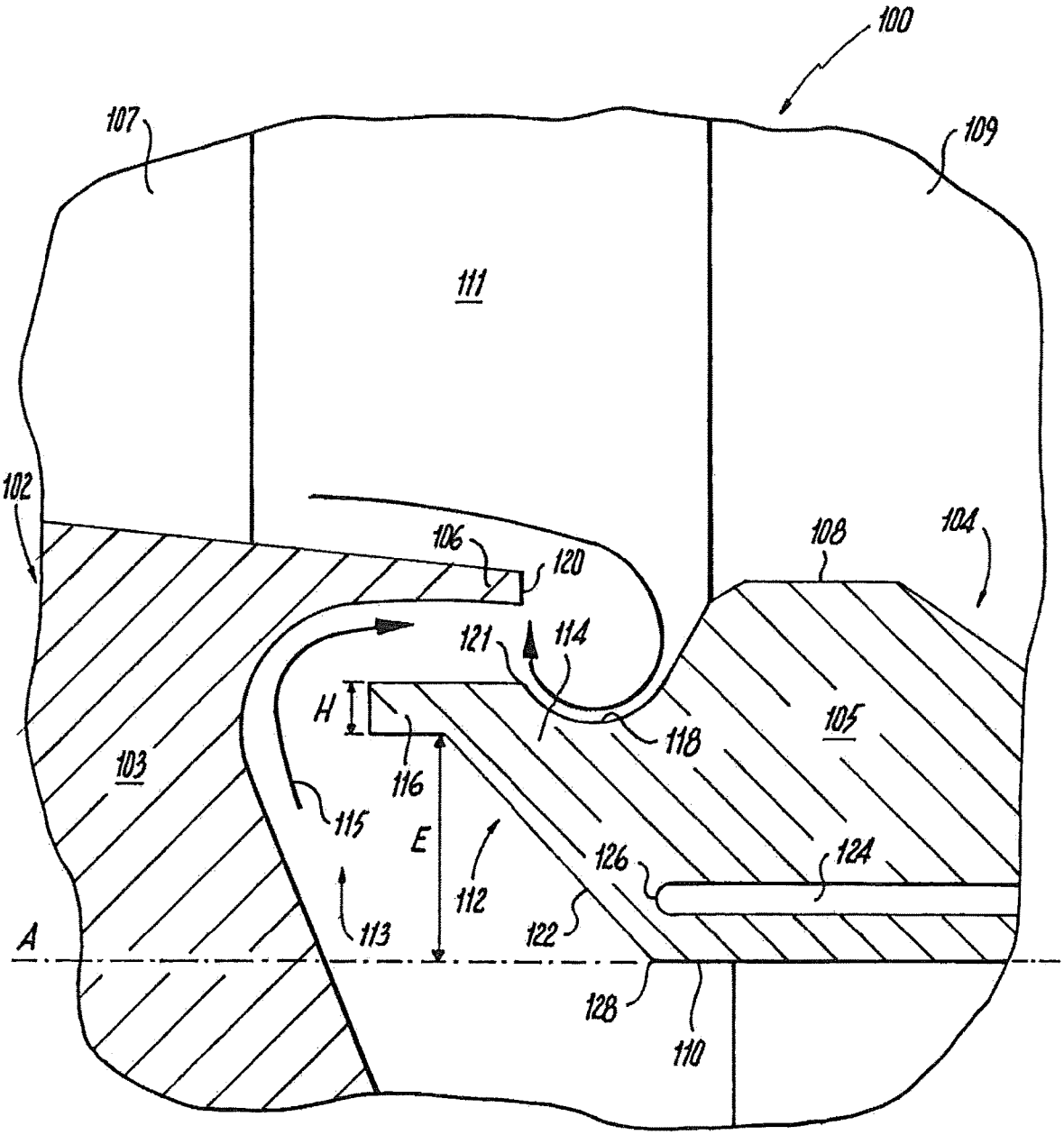
FIG. 2 is a schematic cross-sectional side elevation view of a portion of the gas turbine of FIG. 1, showing a blade platform and a vane platform.

Now with reference to FIG. 2, gas turbine engine 100 includes a first platform 102, e.g. a blade platform, and a second platform 104, e.g. a vane platform, downstream of first platform 102. Each of first and second platforms has respective platform bodies 103 and 105, respectively. First platform 102 is operatively connected to a rotor blade 107, for example a rotor blade in rotor blade stage 23, shown in FIG. 1. Second platform 104 is a vane platform operatively connected to a stator vane 109. Both first and second platforms, 102 and 104, respectively, and their respective blade and vane, 107 and 109, respectively, are defined within a main gas path 111 of gas turbine engine 100. Those skilled in the art will readily appreciate that while first and second platforms are shown and described herein as blade and vane platforms, respectively, first and second platforms can be just blade platforms or just vane platforms, the first platform can be a vane platform and the second platform can be a blade platform, and/or any other suitable variations thereof.

With continued reference to FIG. 2, first platform 102 includes a downstream extending flange 106. Second platform 104 includes an airfoil support surface 108 and an axially extending base surface 110, e.g. along longitudinal axis A, opposite airfoil support surface 108, and a leading edge 112. Leading edge 112 includes an upstream extending flange 114 with a raised portion 116 and a trough portion 118 downstream of and radially inward from raised portion 116. The raised portion 116 includes a top radially outward surface 117*a* and a bottom radially inward surface 117*b* that is disposed opposite and is disposed parallel to the top radially outward surface 117*a*. The top radially outward surface 117*a* has an axial length that is greater than an axial length of the bottom radially inward surface 117*b*. Raised portion 116 and trough portion 118 are configured to hold a vortex of fluid flow, as shown schematically with the swirling arrow, inhibiting ingestion of fluid from main gas path 111 into a rim cavity 113. Rim cavity 113 is defined radially inward from leading edge 112. It is contemplated that the discourager and trough configurations described above can be used in conjunction with purge flow, shown schematically by an arrow 115.

Downstream extending flange 106 of first platform 102 axially overlaps raised portion 116 of leading edge 112 of second platform 104. When first and second platforms, 102 and 104, respectively, are at equilibrium temperature, an axial position of a downstream edge 120 of downstream extending flange 106 is substantially equal to an axial position of an intersection 121 of the top radially outward surface 117*a* of raised portion 116 and trough portion 118. Due to the axial position of raised portion 116, and the length of raised portion 116, described below, first platform 102 is configured to move circumferentially with respect to second platform 104 while still maintaining the axial overlap between downstream extending flange 106 of first platform 102 and raised portion 116 of leading edge 112 of second platform 104.

With continued reference to FIG. 2, second platform 104 includes an axially extending feather seal opening 124 defined between airfoil support surface 108 and base surface 110. An axial position of an upstream edge 126 of feather seal opening 124 is substantially equal to an axial position of an upstream edge 128 of base surface 110, e.g. at an intersection of base surface 110 and a converging surface 122. Those skilled in the art will readily appreciate that the axial position of feather seal opening 124 consequently affects the placement of a feather seal, not shown. This axial position of upstream edge 126 of feather seal opening 124 tends to reduce leakage of purge flow 115 at the axial interfaces between platforms in the same stage compared to traditional platform interfaces. This reduction increases the effectiveness of purge flow 115 in reducing the ingestion at the interface between blade platform 102 and vane platform 104, potentially reducing the amount of purge flow 115 required and reducing losses.

Figure 5:
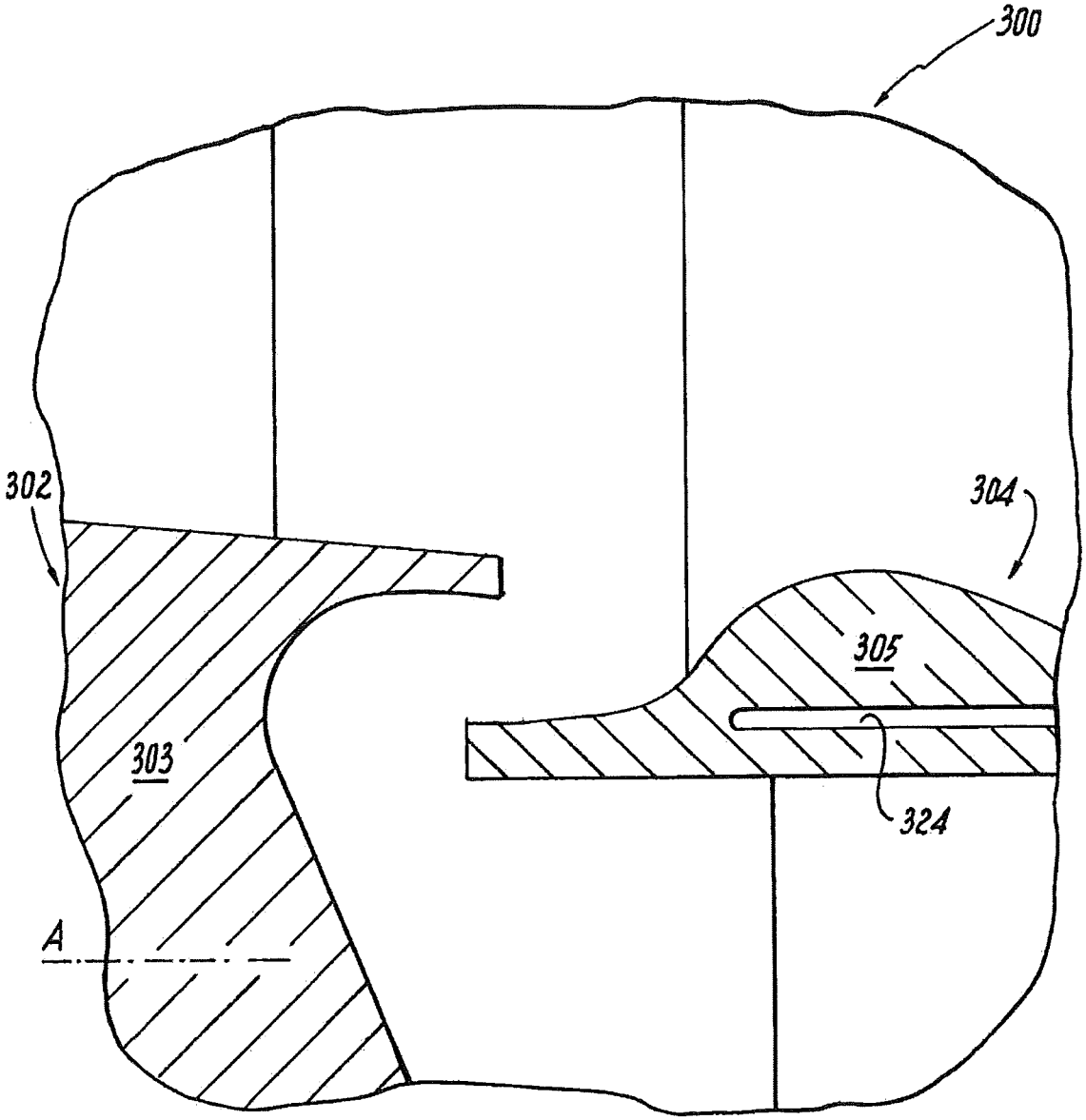
FIG. 5 is a schematic cross-sectional side elevation view of a portion of a gas turbine engine with traditional platforms.

Upstream extending flange 114 includes a converging surface 122 at an angle relative to axially extending base surface 110 and converges in a direction toward axially extending base surface 110, e.g. toward longitudinal axis A. Converging surface 122 connects upstream extending flange 114 to base surface 110. Those skilled in the art will readily appreciate that the increased thickness created by converging surface 122 allows for feather seal opening 124 to be defined farther upstream than feather seal openings found on traditional airfoil platforms, for example, a feather seal opening 324 as shown in FIG. 5. Further, those skilled in the art will readily appreciate that a height H of raised portion 116 is can be as thin as manufacturing allows, for example 0.010 inches but can be thicker as needed to meet various design requirements, such as structural and thermal requirements.

Figure 4:
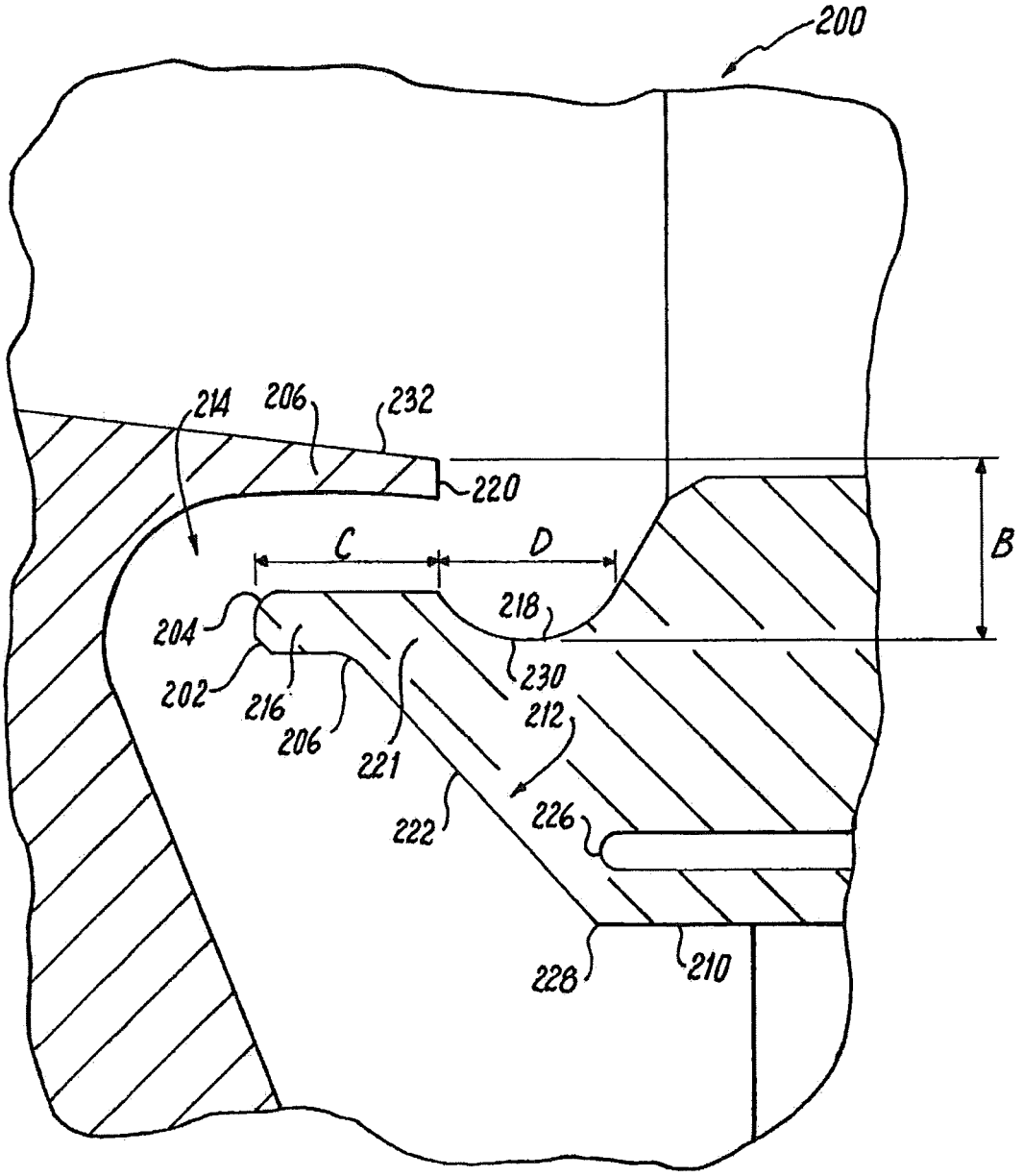
FIG. 4 is a schematic cross-sectional side elevation view of a portion of another exemplary embodiment of a gas turbine engine constructed in accordance with the present disclosure, showing break-edges and rounded corner features.

With reference to FIG. 4, turbomachine 200 is substantially similar to turbomachine 100, except that raised portion 216 is different from raised portion 116. Raised portion 216 has a break-edge 202 on the bottom radially inward corner, a rounded corner 204 on the top radially outward corner, and a blended surface 206 between raised portion 216 and converging surface 222. Those skilled in the art will readily appreciate that break-edges, rounded corners and blended surfaces can be used in a variety of suitable locations throughout the platforms and are not limited to the specific corners and locations shown in FIG. 4. For example, instead of having a rounded corner 204, the top radially outward corner can have a break-edge 202, and/or bottom radially inward corner can have a rounded corner 204.

With reference now to FIGS. 2 and 5, converging surface 122 also contributes to feather seal opening 124 being able to be defined further upstream than a traditional feather seal opening, e.g. a feather seal opening 324 of traditional second platform 304, shown in FIG. 5. Those skilled in the art will readily appreciate that the incorporation of trough 118 tends to push feather seal opening 124 aft. The increase in the height E of the platform that converging surface 122 creates allows feather seal opening 124 to be moved forward, while still including trough 118. While converging surface 122 is shown as an angled linear surface, those skilled in the art will readily appreciate that converging surface 122 can be curved, stepped, or rounded. It is also contemplated that the average slope may be near radial (very steep) to near axial (very shallow), as needed to maintain a minimum gap between converging surface 122 and first platform 103.

Figure 3:
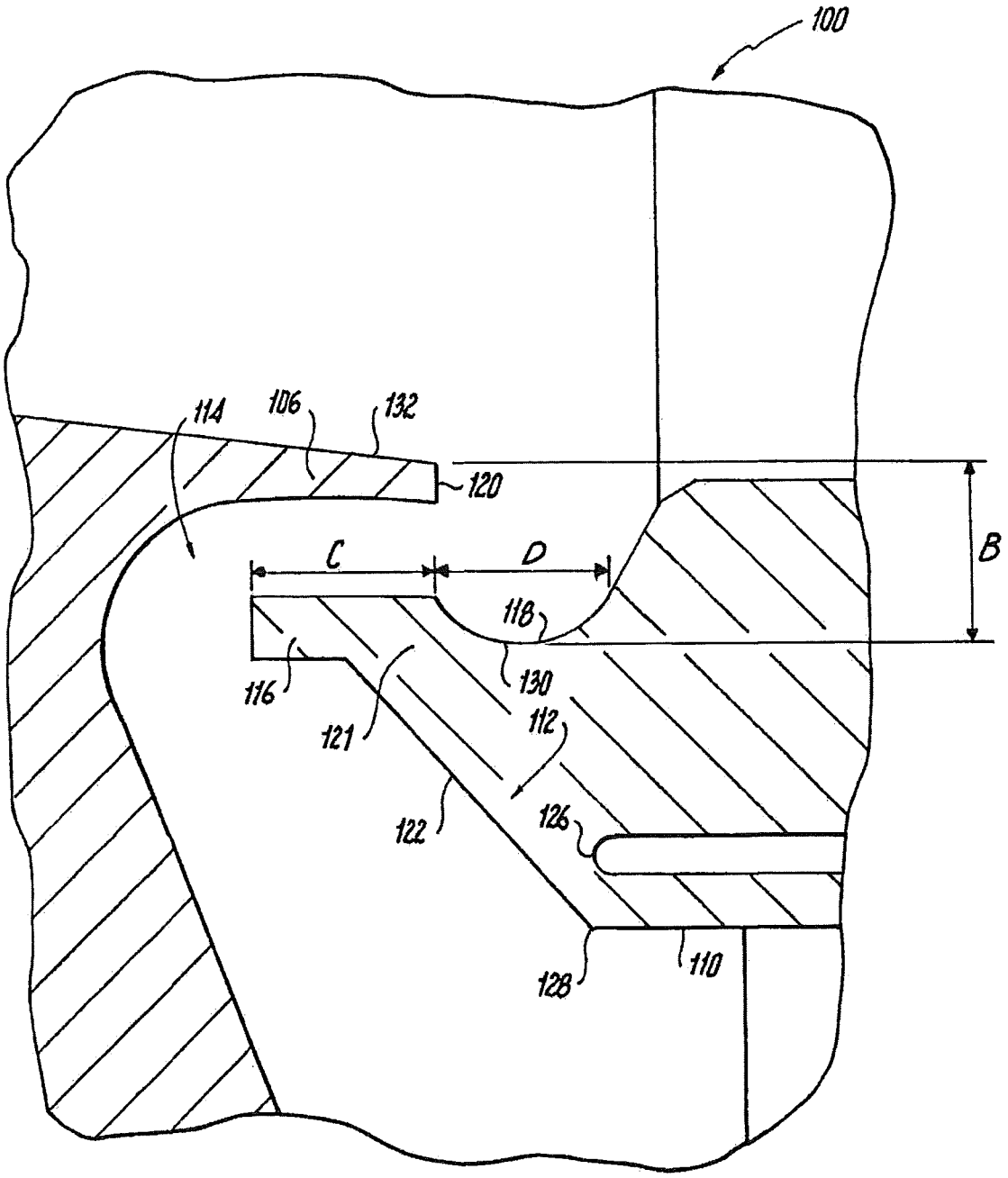
FIG. 3 is a schematic cross-sectional side elevation view of a portion of the gas turbine engine of FIG. 1, showing the interface between a blade platform and a vane platform.

As shown in FIG. 3, a radial distance B between a bottom 130 of trough portion 118 and an outer surface 132 of downstream extending flange 106 is approximately two times the radius of curvature of trough portion 118. An axial length C of the top radially outward surface 117*a* of raised portion 116 is substantially equal to an axial length D of an opening of the trough portion. It is contemplated that radial distance B can be approximately equal to axial length D in order to develop a vortex that acts to block the radial gap between downstream extending flange 106 and leading edge 112.

The methods and systems of the present disclosure, as described above and shown in the drawings, provide for gas turbine engines with superior properties including reduced ingestion of fluid from the gas path, and reduced purge flow needed. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A platform comprising:

a platform body having:

an airfoil support surface;

an axially extending base surface opposite the airfoil support surface; and a leading edge including an upstream extending flange with a raised portion and a trough portion downstream of and radially inward from the raised portion for holding a vortex of fluid flow, the raised portion has a rounded corner on a top radially outward corner, the upstream extending flange includes a converging surface connecting the upstream extending flange to the base surface, the converging surface converges in a direction toward the axially extending base surface and is at an angle relative to the base surface, wherein an axial length of the raised portion is substantially equal to an axial length of an opening of the trough portion, and wherein a radial distance between a bottom of the trough portion and an outer surface of a downstream extending flange of an upstream platform is approximately equal to the axial length.

2. The platform as recited in claim 1, wherein the raised portion of the leading edge is configured to be axially overlapped by the downstream extending flange of the upstream platform.

3. The platform as recited in claim 1, further comprising an axially extending feather seal opening defined between the airfoil support surface and the base surface.

4. The platform as recited in claim 3, wherein an axial position of an upstream edge of the feather seal opening is substantially equal to an axial position of an intersection of the base surface and the converging surface.

5. The platform as recited in claim 3, wherein an axial position of an upstream edge of the feather seal opening is substantially equal to an axial position of the upstream edge of the base surface.

6. The platform as recited in claim 1, wherein the airfoil support surface is operatively connected to a stator vane.

7. A platform comprising:

a platform body having:

an airfoil support surface;

an axially extending base surface opposite the airfoil support surface;

an axially extending feather seal opening defined between the airfoil support surface and the base surface; and a leading edge including an upstream extending flange with a raised portion and a trough portion downstream of and radially inward from the raised portion for holding a vortex of fluid flow, wherein a blended surface extends between the raised portion and a converging surface, wherein an axial position of an upstream edge of the feather seal opening is substantially equal to an axial position of the upstream edge of the base surface, wherein an axial length of the raised portion is substantially equal to an axial length of an opening of the trough portion, and wherein a radial distance between a bottom of the trough portion and an outer surface of a downstream extending flange of an upstream platform is approximately equal to the axial length.

8. The platform as recited in claim 7, wherein the upstream extending flange includes the converging surface connecting the upstream extending flange to the base surface, wherein the converging surface converges in a direction toward the axially extending base surface and is at an angle relative to the base surface.

9. The platform as recited in claim 8, wherein the axial position of the upstream edge of the feather seal opening is substantially equal to an axial position of an intersection of the base surface and the converging surface.

10. A turbomachine, comprising:

a first platform including a downstream extending flange; and a second platform downstream of the first platform, wherein the second platform includes:

an airfoil support surface;

an axially extending base surface opposite the airfoil support surface; and a leading edge including an upstream extending flange with a raised portion and a trough portion downstream of and radially inward from the raised portion for holding a vortex of fluid flow, wherein the downstream extending flange of the first platform axially overlaps the raised portion of the leading edge of the second platform, and wherein, when at equilibrium temperature, an axial position of a downstream edge of the downstream extending flange is equal to an axial position of an intersection of the raised portion and the trough portion and wherein an axial length of the raised portion is substantially equal to an axial length of an opening of the trough portion, and wherein a radial distance between a bottom of the trough portion and an outer surface of the downstream extending flange of the first platform is approximately equal to the axial length.

11. The turbomachine as recited in claim 10, wherein the upstream extending flange includes a converging surface connecting the upstream extending flange to the base surface, wherein the converging surface converges in a direction toward the axially extending base surface and is at an angle relative to the base surface.

12. The turbomachine as recited in claim 11, further comprising an axially extending feather seal opening defined between the airfoil support surface and the base surface, wherein an upstream edge of the feather seal opening is defined at an axial position substantially equal to an axial position of an intersection of the base surface and the converging surface.

13. The turbomachine as recited in claim 10, further comprising an axially extending feather seal opening defined between the airfoil support surface and the base surface.

14. The turbomachine as recited in claim 13, wherein an axial position of an upstream edge of the feather seal opening is substantially equal to an axial position of the upstream edge of the base surface.

15. The turbomachine as recited in claim 10, wherein an axial length of the raised portion is substantially equal to an axial length of an opening of the trough portion.

16. The turbomachine as recited in claim 10, wherein the radial distance between the bottom of the trough portion and the outer surface of the downstream extending flange is two times a radius of curvature of the trough portion.

17. The turbomachine as recited in claim 10, wherein the first platform is a blade platform operatively connected to a rotor blade, wherein the blade platform is configured to move circumferentially with respect to the second platform while still maintaining an axial overlap between the downstream extending flange of the blade platform and the raised portion of the leading edge of the second platform.

18. The turbomachine as recited in claim 10, wherein the second platform is a vane platform operatively connected to a stator vane.

* * * * *